US009044964B2

(12) United States Patent
Lim et al.

(10) Patent No.: US 9,044,964 B2
(45) Date of Patent: Jun. 2, 2015

(54) MICRO BALLPOINT PEN AND PRINTING APPARATUS

(75) Inventors: SangChul Lim, Daejeon (KR); Yong Suk Yang, Daejeon (KR); Seongdeok Ahn, Daejeon (KR); Kyoung Ik Cho, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 324 days.

(21) Appl. No.: 13/604,708

(22) Filed: Sep. 6, 2012

(65) Prior Publication Data

US 2013/0081570 A1 Apr. 4, 2013

(30) Foreign Application Priority Data

Sep. 30, 2011 (KR) ..... 10-2011-0099871

(51) Int. Cl.

| | |
|---|---|
| ***B43K 7/10*** | (2006.01) |
| ***B41J 3/36*** | (2006.01) |
| *B43K 1/08* | (2006.01) |

(52) U.S. Cl.

CPC ... *B41J 3/36* (2013.01); *B43K 1/086* (2013.01)

(58) Field of Classification Search

USPC ..... 401/209, 214, 215, 216, 219; 347/108, 347/109; 346/140.1, 143; 101/93.04, 93.11, 101/93.12

See application file for complete search history.

(56) References Cited

U.S. PATENT DOCUMENTS

| | | | | |
|---|---|---|---|---|
| 3,886,311 | A * | 5/1975 | Rodgers et al. | 178/20.04 |
| 4,527,918 | A * | 7/1985 | Yamamoto et al. | 400/82 |
| 7,083,352 | B2 | 8/2006 | Ando et al. | |
| 7,654,665 | B2 * | 2/2010 | Gray et al. | 347/109 |
| 7,845,790 | B2 | 12/2010 | Baker et al. | |
| 8,591,133 | B2 * | 11/2013 | Ho | 401/214 |

FOREIGN PATENT DOCUMENTS

| | | |
|---|---|---|
| KR | 10-2003-0035990 | 5/2003 |
| KR | 10-2007-0084841 A | 8/2007 |
| KR | 20-2008-0003348 | 8/2008 |
| KR | 10-2009-0029696 A | 3/2009 |

OTHER PUBLICATIONS

Greiner et al, "Electrospinning: A Fascinating Method for the Preparation of Ultrathin Fibers" *Angew. Chem. Int. Ed.*, 2007, 46, pp. 5670-5703, 2007 Wiley-VCH Verlag GmbH & Co. KGaA, Weinheim, DOI: 10.1002/anie.200604646.

Reznik et al.: "Transient and steady shapes of droplets attached to a surface in a strong electric field" *J. Fluid Mech.*(2004), vol. 516, pp. 349-377, 2004 Cambridge University Press, DOI: 10.1017/S0022112004000679.

Choi et al.: "Fountain-pen-based laser microstructuring with gold nanoparlicle inks" *Applied Physics Letters*, vol. 85, No. 1, Jul. 5, 2004, pp. 13-15, 2004 American Institute of Physics, DOI 10.1063/1.1767281.

* cited by examiner

*Primary Examiner* — David Walczak
(74) *Attorney, Agent, or Firm* — Rabin & Berdo, P.C.

(57) ABSTRACT

A micro ballpoint pen enabling to print directly straight, oblique, curved, dashed, broken and wavy lines and a printing apparatus including the same. The micro ballpoint pen may include a tip body including a caulking portion, at least one inner protrusion, and at least one expansible or shrinkable elastic portion, a ball provided between the caulking portion and the inner protrusion, the ball contacting and rolling on a target printing object to eject ink onto the target printing object, a supporting bar pressing the ball toward the caulking portion to form an ink outflowing channel between the caulking portion and the ball, and a control part expanding or shrinking the elastic portion to control the ink outflowing channel.

17 Claims, 11 Drawing Sheets

MICRO BALLPOINT PEN AND PRINTING APPARATUS

CROSS-REFERENCE TO RELATED APPLICATIONS

This U.S. non-provisional patent application claims priority under 35 U.S.C. §119 to Korean Patent Application No. 10-2011-0099871, filed on Sep. 30, 2011, in the Korean Intellectual Property Office, the entire contents of which are hereby incorporated by reference.

BACKGROUND OF THE INVENTION

Embodiments of the inventive concepts relate to a micro ballpoint pen and a printing apparatus, and in particular, a micro ballpoint pen configured to perform a printing operation in a direct contact manner, and a printing apparatus including the same.

Electronic devices may be fabricated using fine and elaborated printing methods, e.g., inkjet printing, screen printing, offset printing, flexography, and gravure. For example, these printing methods may be applied to various technical fields, such as a flat-panel display device (e.g., a liquid crystal display (LCD), an organic light emitting device (OLED), an organic thin film transistor (OTFT)), a flexible display device (e.g., E-paper), a printed electronics (e.g., metal wires), or bio-electronics.

In the inkjet printing method, tiny ink droplets may be ejected on a desired position of a target printing object to form a printed image. However, there are technical difficulties in controlling exactly a falling position of the ink droplet, changing a printing thickness range, preventing ink from being blurred, and printing a continuous line. By contrast, all of screen printing, offset printing, flexography, and gravure may need an engraving resulting in an increase in ink consumption and a limitation in printing resolution.

There is a near-field electro-spinning method, which is one of line printing methods, not a point or plane printing method. However, for the near-field electro-spinning method, a line is printed using a high electric field, it is hard to print a dashed line, a bulge may occur at an end of line, and there is a limitation in using various kinds of inks. In addition, since the method is sensitive to a distortion of electric field, it is hard to prevent an interference issue, especially in the case of using a multi-nozzle.

Furthermore, there is a dip-pen or nano fountain-pen method, which is developed from an atomic force microscope (AFM) measuring a fine structure in an atomic level, but this method suffers from a very expensive apparatus cost and a small printing area.

So far, there has been a technical difficulty in applying a ballpoint pen for a high resolution printing apparatus. This is because it is hard to control exactly a ball gap, which is formed between a ball and a pen tip, and through which ink is outflowed by a rolling ball. In other words, it is hard to control an ejecting amount of ink exactly. To realize a high resolution printing, it is necessary to be able to control finely the ball gap, a pressure applied to a target object by a ball, a frictional force at an interface, a revolution number of a ball.

SUMMARY

Example embodiments of the inventive concept provide a micro ballpoint pen enabling to print directly straight, oblique, curved, dashed, broken and wavy lines, which may be hard to be printed by a conventional printing method and a printing apparatus including the same.

Other example embodiments of the inventive concept provide a micro ballpoint pen enabling to print directly a line in the order of micro-meter and a printing apparatus including the same.

Still other example embodiments of the inventive concept provide a micro ballpoint pen enabling to print a complex line or pattern (e.g., having a complex edge) without a shadow mask or an engraving and a printing apparatus including the same.

Even other example embodiments of the inventive concept provide a micro ballpoint pen capable of reducing ink consumption and a printing apparatus including the same.

According to example embodiments of the inventive concepts, a micro ballpoint pen may include a tip body including a caulking portion, at least one inner protrusion, and at least one expansible or shrinkable elastic portion, a ball provided between the caulking portion and the inner protrusion, the ball contacting and rolling on a target printing object to eject ink onto the target printing object, a supporting bar pressing the ball toward the caulking portion to form an ink outflowing channel between the caulking portion and the ball, and a control part expanding or shrinking the elastic portion to control the ink outflowing channel.

In example embodiments, the elastic portion may include an elastic electrode and a piezoelectric actuator, and the piezoelectric actuator may be surrounded by the elastic electrode and may be bent toward an inner space of the tip body in response to a control signal transmitted from the control part through the elastic electrode.

In example embodiments, the at least one elastic portion may be provided in a side wall of the tip body and the number of the at least one elastic portion may be one or more, a lower portion of the supporting bar may be in contact with the ball, a side surface of an upper portion of the supporting bar may be in contact with an inner side surface of the elastic portion, the piezoelectric actuator may be bent to press the supporting bar toward the caulking portion, and the ink outflowing channel may be controlled by changing a position of the supporting bar.

In example embodiments, the micro ballpoint pen may further include a pressure measuring part measuring a pressure between the ball and the target printing object and sending the measurement result to the control part.

In example embodiments, the upper portion of the supporting bar defines a hole allowing the ink to be delivered to a surface of the ball.

In example embodiments, the elastic portion may be in contact with a top surface of an upper portion of the supporting bar, a lower portion of the supporting bar may be in contact with the ball, the upper portion of the supporting bar may be in contact with an inner surface of the elastic portion. The piezoelectric actuator may be bent to press the supporting bar toward the caulking portion, and the ink outflowing channel may be controlled by changing a position of the supporting bar.

In example embodiments, the elastic portion may include a deformable piezoelectric material, an electrode, and a membrane, and the piezoelectric material may be upward or downward moved to press the membrane, in response to a control signal transmitted from the control part through the electrode.

In example embodiments, the elastic portion may be in contact with a top surface of an upper portion of the supporting bar, a lower portion of the supporting bar may be in contact with the ball, an upper portion of the supporting bar may be in contact with the membrane, the membrane may be bent toward an inner space of the tip body by the pressing of the piezoelectric material, thereby pressing the supporting bar toward the caulking portion, and the ink outflowing channel may be controlled by changing a position of the supporting bar.

In example embodiments, the micro ballpoint pen may further include a pressure measuring part measuring a pressure between the ball and the target printing object and sending the measurement result to the control part.

According to example embodiments of the inventive concepts, a printing apparatus may include a stage loading a target printing object and being movable along X-, Y- and/or Z-axis, a micro ballpoint pen ejecting ink onto the target printing object, and a control part controlling operations of the stage and the micro ballpoint pen. The micro ballpoint pen may include a tip body including a caulking portion, at least one inner protrusion, and at least one elastic portion, whose expansion or shrinkage may be controlled by the control part, a ball provided between the caulking portion and the inner protrusion, the ball contacting and rolling on a target printing object to eject ink onto the target printing object, and a supporting bar pressing the ball toward the caulking portion to form an ink outflowing channel between the caulking portion and the ball.

In example embodiments, the control part may include a pressure measuring part measuring a pressure between the ball and the target printing object.

In example embodiments, the elastic portion may include an elastic electrode and a piezoelectric actuator, the piezoelectric actuator may be surrounded by the elastic electrode and may be bent toward an inner space of the tip body in response to a control signal from the control part, the piezoelectric actuator may be bent to press the supporting bar toward the caulking portion, and the ink outflowing channel may be controlled by changing a position of the supporting bar.

In example embodiments, the elastic portion may include a deformable piezoelectric material, an electrode, and a membrane, the piezoelectric material may be upward or downward moved to press the membrane, in response to a control signal from the control part, the membrane may be bent toward an inner space of the tip body by the pressing of the piezoelectric material, thereby pressing the supporting bar toward the caulking portion, and the ink outflowing channel may be controlled by changing a position of the supporting bar.

In example embodiments, the control part may include a micro ballpoint pen control part controlling extension or shrinkage of the elastic portion to control an operation of the micro ballpoint pen, and a stage control part controlling an operation of the stage.

In example embodiments, the printing apparatus may further include an ink supplying part configured to supply the ink into the micro ballpoint pen, in response to the control signal of the control part.

In example embodiments, the control part may include a micro ballpoint pen control part controlling extension or shrinkage of the elastic portion to control an operation of the micro ballpoint pen, a stage control part controlling an operation of the stage, and an ink supplying control part controlling the ink supplying part.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

Figure 1:
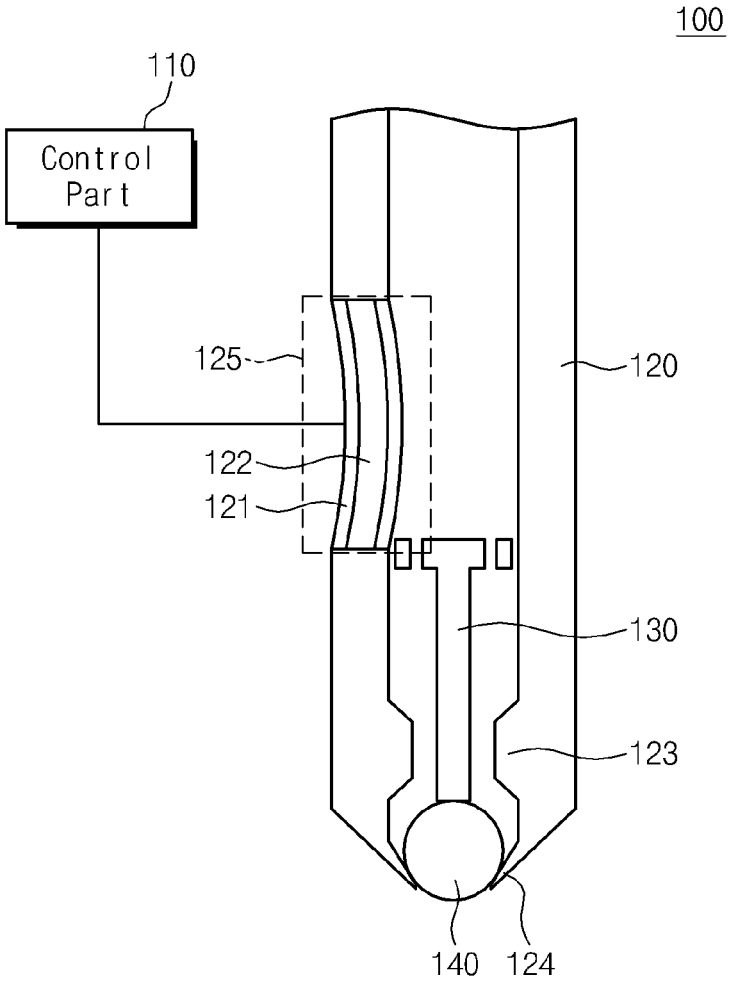
FIG. 1 is a diagram illustrating a micro ballpoint pen according to example embodiments of the inventive concept.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of molecules, layers, regions and/or structural elements may be reduced or exaggerated for clarity. The use of similar or identical reference numbers in the various drawings is intended to indicate the presence of a similar or identical element or feature.

DETAILED DESCRIPTION

Example embodiments of the inventive concepts will now be described more fully with reference to the accompanying drawings, in which example embodiments are shown. Example embodiments of the inventive concepts may, however, be embodied in many different forms and should not be construed as being limited to the embodiments set forth herein; rather, these embodiments are provided so that this disclosure will be thorough and complete, and will fully convey the concept of example embodiments to those of ordinary skill in the art. In the drawings, the thicknesses of layers and regions are exaggerated for clarity. Like reference numerals in the drawings denote like elements, and thus their description will be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers indicate like elements throughout. As used herein the term "and/or" includes any and all combinations of one or more of the associated listed items. Other words used to describe the relationship between elements or layers should be interpreted in a like fashion (e.g., "between" versus "directly between," "adjacent" versus "directly adjacent," "on" versus "directly on").

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Example embodiments of the inventive concepts are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments of the inventive concepts should not be construed as limited to the particular shapes of regions illustrated herein but are to include deviations in shapes that result, for example, from manufacturing. For example, an implanted region illustrated as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments of the inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

FIG. 1 is a diagram illustrating a micro ballpoint pen according to example embodiments of the inventive concept. Referring to FIG. 1, a micro ballpoint pen 100 may include a control part 110, a tip body 120, a supporting bar 130, and a ball 140.

The tip body 120 may include a caulking portion 124, an inner protrusion 123, and an elastic portion 125.

The caulking portion 124 may be configured to prevent the ball 140 provided in the tip body 120 from coming out. To do this, the caulking portion 124 may be formed to have a shape bent inward from an end portion of the tip body 120. The caulking portion 124 may form an ink outflowing channel along with the ball 140. To prevent an outward deviation of the ball 140, an inside diameter of the caulking portion 124 may be smaller than an outside diameter of the ball 140.

The inner protrusion 123 may be positioned on an inner wall of the tip body 120 and at the rear of the caulking portion 124. Due to the presence of the inner protrusion 123, it is possible to prevent the ball 140 from being upward moved beyond a predetermined vertical level, even if the supporting bar 130 pressing the ball 140 toward the caulking portion 124 is excessively moved upward.

The elastic portion 125 may be expanded or shrunk with a specific expansion coefficient in response to a control signal. In example embodiments, one or more elastic portion 125 may be provided in a side wall of the tip body 120, and the elastic portion 125 may include an elastic electrode 121 and a piezoelectric actuator 122.

The elastic electrode 121 may be configured to have flexibility and transmit an electrical signal to other object connected thereto. In example embodiments, the elastic electrode 121 may be configured to transmit a control signal received from the control part 110 to the piezoelectric actuator 122.

The piezoelectric actuator 122 may include at least one of piezoelectric materials, whose shape can be changed by a voltage applied thereto. In other words, the use of the piezoelectric actuator 122 enables to convert an electric force corresponding to the applied voltage into a mechanical force, such as a bending effect. In example embodiments, the piezoelectric actuator 122 may be surrounded by the elastic electrode 121. The piezoelectric actuator 122 may be bent toward an inner space of the tip body 120, in response to the control signal from the control part 110, which may be received through the elastic electrode 121.

The supporting bar 130 may press the ball 140 toward the caulking portion 124. Due to the pressure applied by the supporting bar 130, the ball 140 may become in contact with the caulking portion 124, while at least one gap may be formed between the ball 140 and the caulking portion 124. For example, an ink outflowing channel allowing ink to leak out may be formed between the ball 140 and the caulking portion 124, when the supporting bar 130 presses the ball 140 toward the caulking portion 124. In example embodiments, the supporting bar 130 may include a lower portion contacting with the ball 140 and an upper portion with a side wall contacting with an inner side surface of the elastic portion 130.

The ball 140 may be contained between the caulking portion 124 and the inner protrusion 123, such that the ball 140 can be rotated or rolled within the tip body 120. For example, the ball 140 may be configured to be able to rotate or roll on a surface of a target printing object contacted thereby. During the rolling of the ball, the ink on a surface of the ball may be ejected onto the target printing object via the ink outflowing channel.

The control part 110 may be provided at the outside of the tip body 120 and generate the control signal of expanding or shrinking the elastic portion 125. As described above, the ink outflowing channel may be controlled by an operation of the elastic portion 125. In example embodiments, the elastic portion 125 may include the piezoelectric actuator 122, and the piezoelectric actuator 122 may be expanded or shrunk in response to the control signal of the control part 110. For example, in response to the control signal, the piezoelectric actuator 122 may be expanded and bent toward the inner space of the tip body 120, and thus, the elastic portion 125 may be bent toward the inner space of the tip body 120. The inward bending of the piezoelectric actuator 122 may result in pressing the supporting bar 130 toward the caulking portion 124 or pushing the supporting bar 130 downward. Then, the supporting bar 130 may press the ball 140 toward the caulking portion 124 or push the ball 140 downward. In the case where the pressure is greater than a pressure applied to the ball 140 by the target printing object or the atmosphere, the ball 140 may cover the entire inside circumference of the caulking portion 124. In this case, ink on the surface of the ball 140 cannot be leaked, thereby preventing an unintended printing process. By contrast, in the case where the pressure is smaller than a pressure applied to the ball 140 by the target printing object or the atmosphere, the ball 140 may not cover the entire inside circumference of the caulking portion 124. In this case, ink on the surface of the ball 140 can be leaked outward through the ink outflowing channel formed between the ball 140 and the caulking portion 124, thereby performing a printing process.

Figure 2A:
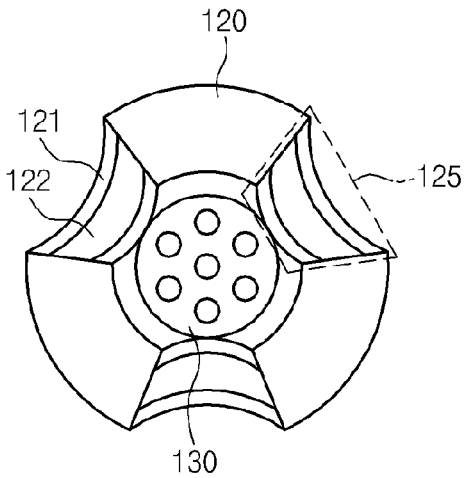
FIG. 2A is a diagram illustrating a horizontal section of a micro ballpoint pen according to example embodiments of the inventive concept.

FIG. 2A is a diagram illustrating a horizontal section of a micro ballpoint pen according to example embodiments of the inventive concept. Referring to FIG. 2A, the tip body 120 may include the elastic portion 125 and the supporting bar 130.

The number of the elastic portion 125 may be one or more. For example, as shown in FIG. 2A, the micro ballpoint pen may include three elastic portions 125. As described with reference to FIG. 1, the elastic portions 125 may be formed in the side wall of the tip body 120, and each of the elastic portions 125 may include the elastic electrode 121 and the piezoelectric actuator 122. The piezoelectric actuator 122 may be surrounded by the elastic electrode 121. The piezoelectric actuator 122 may be bent toward the inner space of the tip body 120, in response to the control signal from the control part (not shown), which may be received through the elastic electrode 121.

The supporting bar 130 may press the ball (not shown) toward the caulking portion (not shown). Due to the pressure applied by the supporting bar, the ball may become in contact with the caulking portion, while at least one gap may be formed between the ball and the caulking portion. For example, the ink outflowing channel allowing ink to leak out may be formed between the ball and the caulking portion, if the supporting bar 130 presses the ball toward the caulking portion.

Figure 2B:
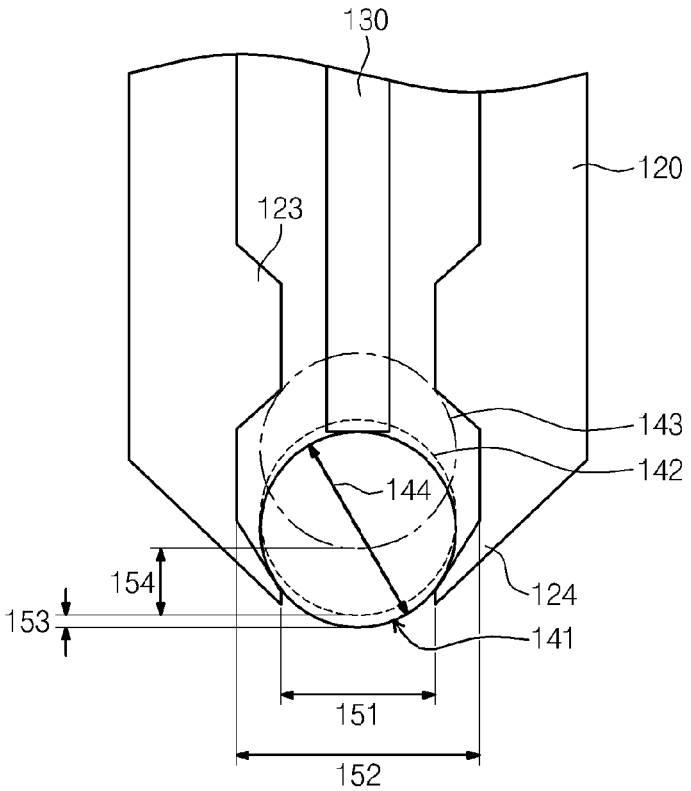
FIG. 2B is a diagram illustrating a ball and a supporting bar provided in a micro ballpoint pen according to example embodiments of the inventive concept.

FIG. 2B is a diagram illustrating a ball and a supporting bar provided in a micro ballpoint pen according to example embodiments of the inventive concept. Referring to FIG. 2B, the ball may be located at, for example, three positions 141, 142, and 143.

An inside diameter 151 of the caulking portion 124 may be smaller than an inside width 152 of the tip body 120. An outside diameter 144 of the ball may be greater than the inside diameter 151 of the caulking portion 124 and be smaller than the inside width 152 of the tip body 120.

The lowermost position 141 of the ball may correspond to the case that the pressure applied from the supporting bar 130 may be maximum. In other words, in the case where the pressure is greater than a pressure applied to the ball by the target printing object or the atmosphere, the ball located at the position 141 may cover the entire inside circumference of the caulking portion 124. In this case, ink on the surface of the ball cannot be leaked out, thereby preventing an unintended printing process. A ball protruding length 153 from the caulking portion 124 may have the maximum, when the ball is positioned at the lowermost position 141.

The intermediate position 142 of the ball may correspond to the case that the pressure applied from the supporting bar 130 may be equivalent but opposite to a pressure applied to the ball by the target printing object. In this case, the ball located at the position 142 may not cover the entire inside circumference of the caulking portion 124, and ink on the surface of the ball 140 can be leaked outward through the ink outflowing channel formed between the ball 140 and the caulking portion 124, thereby performing a printing process.

The uppermost position 143 of the ball may correspond to the case that the pressure applied from the supporting bar 130 may be minimum. In this case, the ball may be spaced apart from the caulking portion, and thus, the ink outflowing channel may be maximally expanded. However, the ball may be prevented from being upward moved beyond the inner protrusion 123; that is, a distance 154 from the position 142 may be determined by the inner protrusion 123.

Figure 2C:
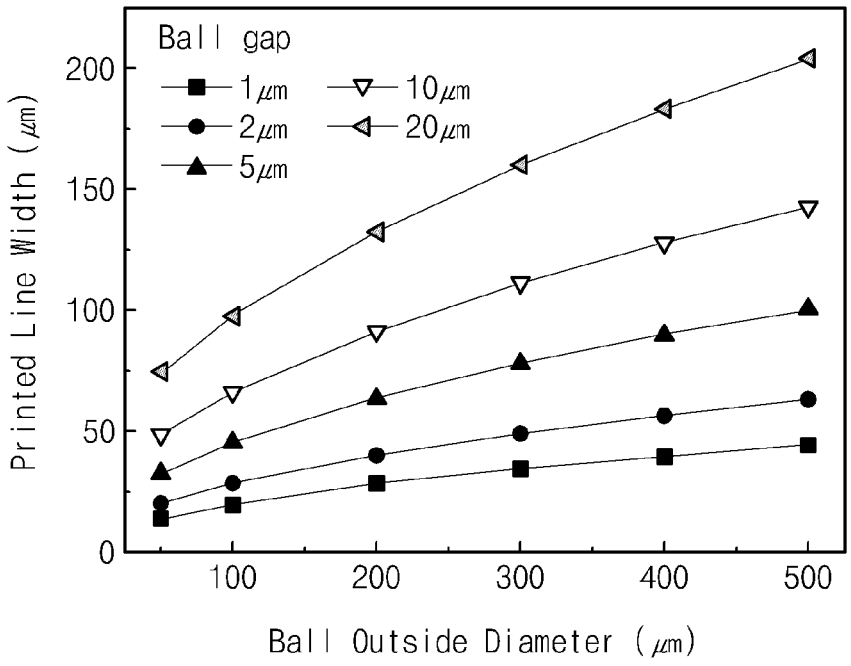
FIG. 2C is a graph showing a relationship between a printed line width and an outside diameter of the ball according to example embodiments of the inventive concept.

FIG. 2C is a graph showing a relationship between a printed line width W and an outside diameter of the ball provided in a micro ballpoint pen according to example embodiments of the inventive concept.

A line width W of ink to be printed on the target printing object may be given by the formula 1.

$$W=2\{(A/2+g)2-(A/2)2\}^{1/2}, \quad \text{[Formula 1]}$$

where a parameter A represents an outside diameter 144 of the ball and a parameter g does a ball gap. From the formula 1, the line width W ranges from 14 μm to 200 μm, when the outside diameter A of the ball varies from 50 μm to 500 μm and the ball gap g varies from 1 μm to 20 μm.

According to example embodiments of the inventive concept, the micro ballpoint pen 100 may control the position and/or movement of the ball 140 using the piezoelectric actuator 122. The ink outflowing channel may be formed in a gap-on-demand (GOD) manner, and the ink may be ejected by a rotating movement of the ball 140 on the surface of the target printing object. Accordingly, the micro ballpoint pen 100 of FIG. 1 can provide various technical advantages in a printing process, such as a fine control of the ink outflowing channel and a simple operational mechanism (e.g., the rotating or rolling of the ball). In addition, since a mechanical deformation of the piezoelectric actuator 122 is used to eject the ink, there is no limitation on ink to be used.

Figure 3:
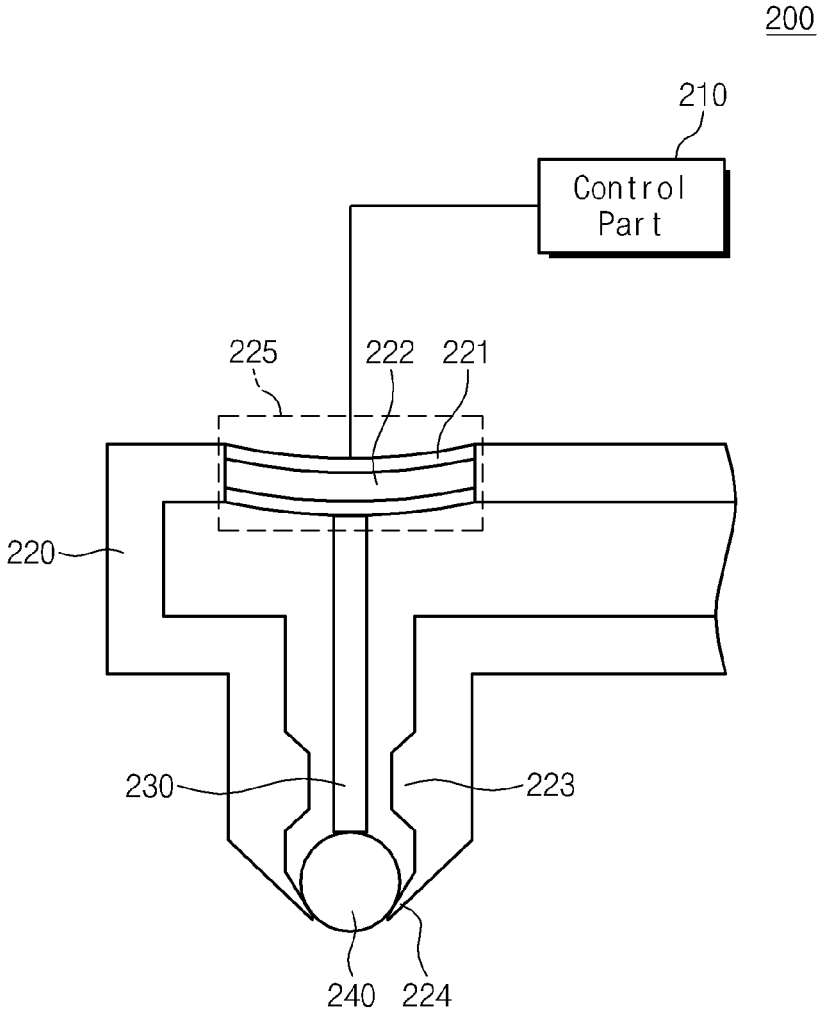
FIG. 3 is a diagram illustrating a micro ballpoint pen according to other example embodiments of the inventive concept.

FIG. 3 is a diagram illustrating a micro ballpoint pen according to other example embodiments of the inventive concept. Referring to FIG. 3, a micro ballpoint pen 200 may include a control part 210, a tip body 220, a supporting bar 230, and a ball 240.

The tip body 220 may include a caulking portion 224, an inner protrusion 223, and an elastic portion 225. The caulking portion 224 and the inner protrusion 223 may be configured to have the same technical features as those in the previous embodiments described with reference to FIG. 1, and thus, detailed discussion thereof will be omitted in order to avoid redundancy.

The elastic portion 225 may be expanded or shrunk with a specific expansion coefficient in response to a control signal. In example embodiments, the elastic portion 225 may be formed to be in contact with a top surface of an upper end portion of the supporting bar 230, and include an elastic electrode 221 and a piezoelectric actuator 222.

The elastic electrode 221 and the piezoelectric actuator 222 may be configured to have the same technical features as those in the previous embodiments described with reference to FIG. 1, and thus, detailed discussion thereof will be omitted in order to avoid redundancy.

The supporting bar 230 may press the ball 240 toward the caulking portion 224. Due to the pressure applied by the supporting bar 230, the ball 240 may become in contact with the caulking portion 224, while at least one gap may be formed between the ball 240 and the caulking portion 224. For example, an ink outflowing channel allowing ink to leak out may be formed between the ball 240 and the caulking portion 224, when the supporting bar 230 presses the ball 240 toward the caulking portion 224. In other example embodiments, the supporting bar 230 may include a lower portion contacting with the ball 240 and an upper portion contacting with an inner surface of the elastic portion 230. The supporting bar 230 of FIG. 3 may not have a hole allowing ink to pass through, unlike the supporting bar 130 of FIG. 1.

The ball 240 may be configured to have the same technical features as those in the previous embodiments described with reference to FIG. 1, and thus, detailed discussion thereof will be omitted in order to avoid redundancy.

The control part 210 may be provided at the outside of the tip body 220 and generate the control signal of expanding or shrinking the elastic portion 225. As described above, the ink outflowing channel may be controlled by an operation of the elastic portion 225. In other example embodiments, the elastic portion 225 may include the piezoelectric actuator 222, and the piezoelectric actuator 222 may be expanded in response to the control signal and bent toward the inner space of the tip body 220. Then, the elastic portion 225 may be bent toward the inner space of the tip body 220, thereby pressing the supporting bar 230 toward the caulking portion 224. As the result, the supporting bar 230 may press the ball 240 toward the caulking portion 224 or push the ball 240 downward.

According to other example embodiments of the inventive concept, the micro ballpoint pen 200 may control the position and/or movement of the ball 240 using the piezoelectric actuator 222. The ink outflowing channel may be formed in a gap-on-demand (GOD) manner, and the ink may be ejected by a rotating movement of the ball 240 rolling on the surface of the target printing object. As a result, the micro ballpoint pen 200 of FIG. 3 can provide various technical advantages in a printing process, such as a fine control of the ink outflowing channel and a simple operational mechanism (e.g., the rotating or rolling of the ball). In addition, since a mechanical deformation of the piezoelectric actuator 222 is used to eject the ink, there is no limitation on ink to be used.

Figure 4:
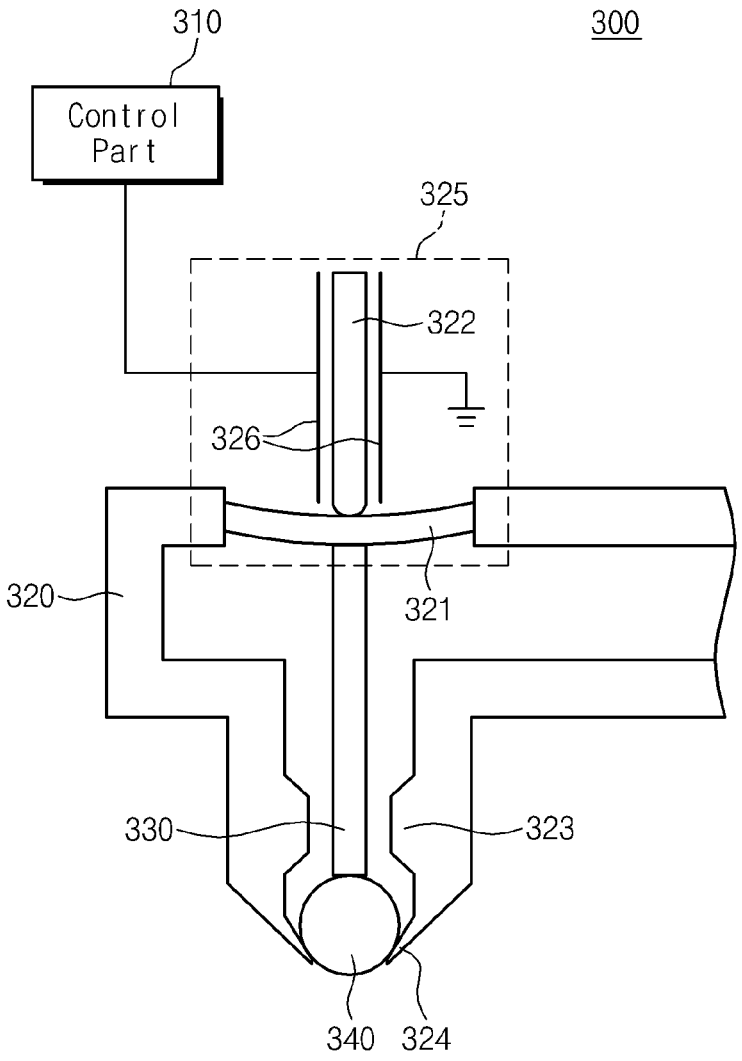
FIG. 4 is a diagram illustrating a micro ballpoint pen according to still other example embodiments of the inventive concept.

FIG. 4 is a diagram illustrating a micro ballpoint pen according to still other example embodiments of the inventive concept. Referring to FIG. 4, a micro ballpoint pen 300 may include a control part 310, a tip body 320, a supporting bar 330, and a ball 340.

The tip body 320 may include a caulking portion 324, an inner protrusion 323, and an elastic portion 325. The caulking portion 324 and the inner protrusion 323 may be configured to have the same technical features as those in the previous embodiments described with reference to FIG. 1, and thus, detailed discussion thereof will be omitted in order to avoid redundancy.

The elastic portion 325 may be expanded or shrunk with a specific expansion coefficient in response to a control signal. In still other example embodiments, the elastic portion 325 may be formed to be in contact with a top surface of an upper end portion of the supporting bar 330, and include a deformable piezoelectric material 322, an electrode 326, and a membrane 321.

The deformable piezoelectric material 322 may be upward or downward moved to press the membrane 321. The movement of the deformable piezoelectric material 322 may be controlled by the control signal received from the control part 310 through the electrode 326

The membrane 321 may be bent toward the inner space of the tip body 320 by the pressing of the deformable piezoelectric material 322, thereby pressing the supporting bar 330 disposed thereunder toward the caulking portion 324.

The supporting bar 330 may press the ball 340 toward the caulking portion 324. Due to the pressure applied by the supporting bar 330, the ball 340 may become in contact with the caulking portion 324, while at least one gap may be formed between the ball 340 and the caulking portion 324. For example, an ink outflowing channel allowing ink to leak out may be formed between the ball 340 and the caulking portion 324, when the supporting bar 330 presses the ball 340 toward the caulking portion 324. In the present embodiments, the supporting bar 330 may include a lower portion contacting with the ball 340 and an upper portion contacting with the membrane 321.

The ball 340 may be configured to have the same technical features as those in the previous embodiments described with reference to FIG. 1, and thus, detailed discussion thereof will be omitted in order to avoid redundancy.

The control part 310 may be provided at the outside of the tip body 320 and generate the control signal of expanding or shrinking the elastic portion 325. As described above, the ink outflowing channel may be controlled by an operation of the elastic portion 325. In the present embodiments, the elastic portion 325 may include the deformable piezoelectric material 322, the electrode 326, and the membrane 321. If the deformable piezoelectric material 322 is downward moved in response to the received control signal, the membrane 321 may be bent toward the inner space of the tip body 320 by the pressing of the deformable piezoelectric material 322, thereby pressing the supporting bar 330 toward the caulking portion 324. As the result of the pressure exerted from the membrane 321, the supporting bar 330 may press the ball 340 toward the caulking portion 324 or push the ball 340 downward.

In the present embodiments, the micro ballpoint pen 300 may control the position and/or movement of the ball 340 using the deformable piezoelectric material 322 and the membrane 321. The ink outflowing channel may be formed in a gap-on-demand (GOD) manner, and the ink may be ejected by a rotating movement of the ball 340 rolling on the surface of the target printing object. As a result, the micro ballpoint pen 300 of FIG. 4 can provide various technical advantages in a printing process, such as a fine control of the ink outflowing channel and a simple operational mechanism (e.g., the rotating or rolling of the ball). In addition, since a mechanical deformation of the deformable piezoelectric material 322 is used to eject the ink, there is no limitation on ink to be used.

Figure 5:
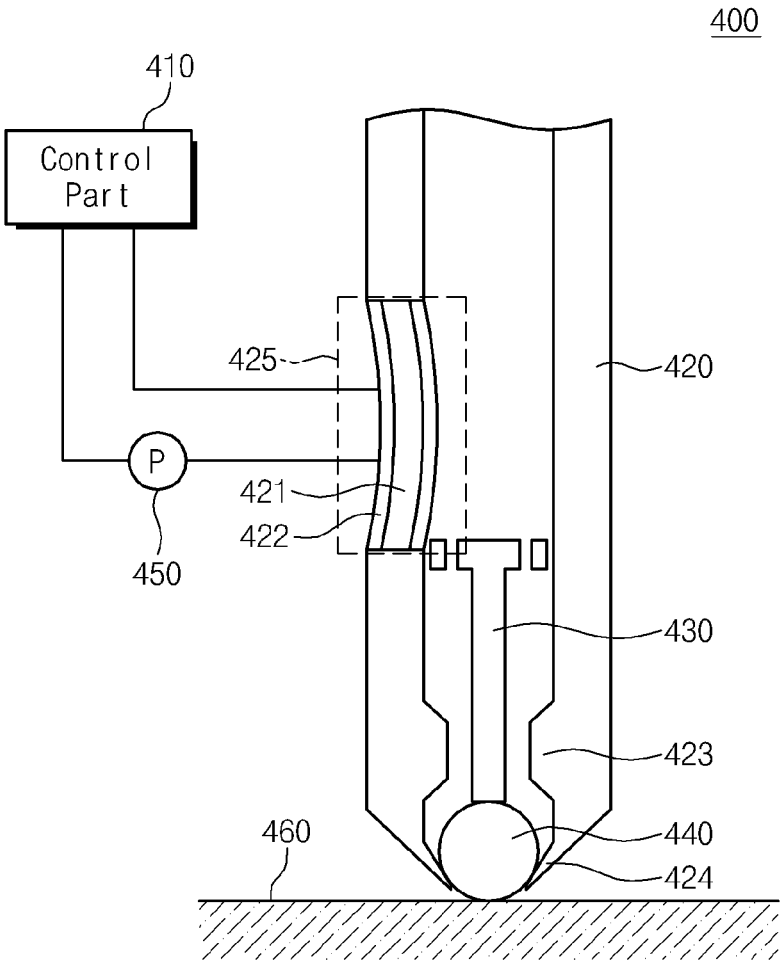
FIG. 5 is a diagram illustrating a micro ballpoint pen according to even other example embodiments of the inventive concept.

FIG. 5 is a diagram illustrating a micro ballpoint pen according to even other example embodiments of the inventive concept. Referring to FIG. 5, a micro ballpoint pen 400 may include a control part 410, a tip body 420, a supporting bar 430, a ball 440, and a pressure measuring part 450.

In the embodiments depicted in FIG. 5, the control part 410, the tip body 420, an elastic portion 425, an elastic electrode 421, a piezoelectric actuator 422, an inner protrusion 423, a caulking portion 424, the supporting bar 430, and the ball 440 may be configured to have the same technical features as those in the previous embodiments described with reference to FIG. 1, and thus, detailed discussion thereof will be omitted in order to avoid redundancy.

Referring to FIG. 5, the pressure measuring part 450 may be configured to measure a pressure between the ball 440 and a target printing object 460 and send the measurement result to the control part 410. If a finite pressure is exerted between the target printing object 460 and the ball 440, a corresponding pressure may applied between the ball 440 and the supporting bar 430, and moreover, between the supporting bar 430 and the elastic portion 425. In other words, although a pressure exerted to the elastic portion 425 by the supporting bar 430 is measured by the pressure measuring part 450, it may be substantially equivalent to a pressure exerted between the target printing object 460 and the ball 440.

In the micro ballpoint pen 400 of FIG. 5, the pressure measured by the pressure measuring part 450 may be sent to the control part 410. This enables to improve uniformity in a pressure between the target printing object 460 and the ball 440, thereby uniformly maintaining the ink outflowing channel during a printing process. Furthermore, due to the presence of the pressure measuring part 450, a change in pressure between the target printing object 460 and the ball 440 can be feedbacked to the control part 410 controlling the tip body 420. This enables to perform an exact printing of a complex pattern (e.g., broken and wavy lines).

Figure 6:
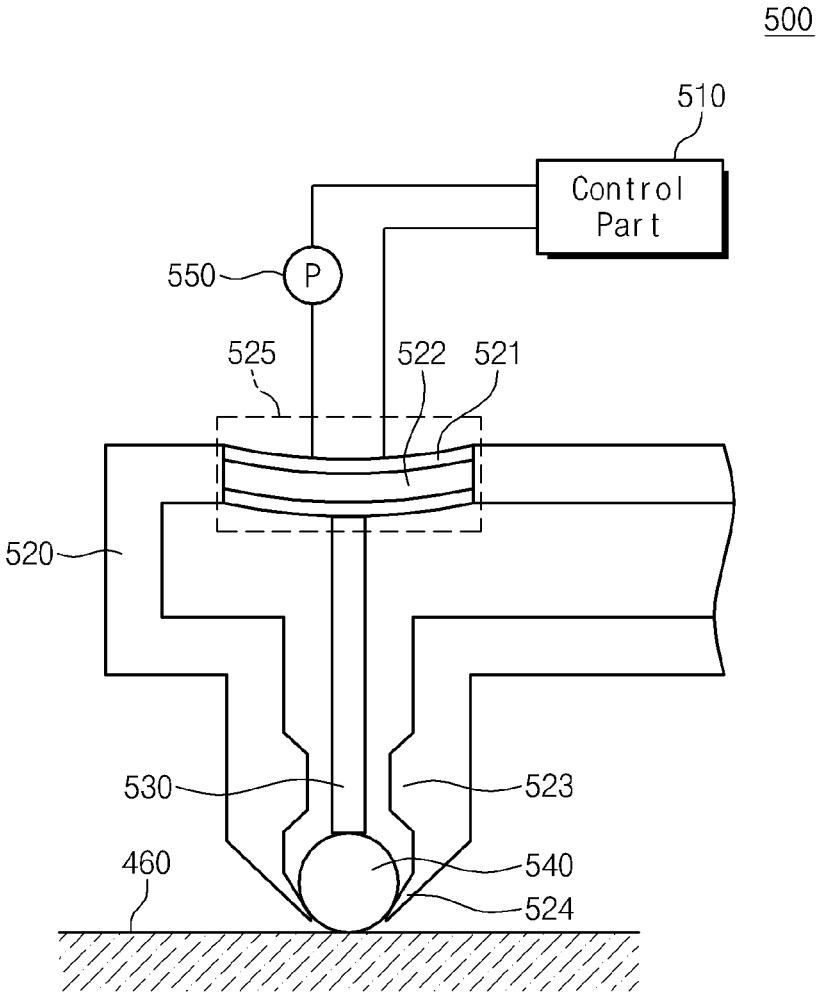
FIG. 6 is a diagram illustrating a micro ballpoint pen according to yet other example embodiments of the inventive concept.

FIG. 6 is a diagram illustrating a micro ballpoint pen according to yet other example embodiments of the inventive concept. Referring to FIG. 6, a micro ballpoint pen 500 may include a control part 510, a tip body 520, a supporting bar 530, a ball 540, and a pressure measuring part 550.

In the embodiments depicted in FIG. 6, the control part 510, the tip body 520, an elastic portion 525, an elastic electrode 521, a piezoelectric actuator 522, an inner protrusion 523, a caulking portion 524, the supporting bar 530, and the ball 540 may be configured to have the same technical features as those in the previous embodiments described with reference to FIG. 3, and thus, detailed discussion thereof will be omitted in order to avoid redundancy.

Referring to FIG. 6, the pressure measuring part 550 may be configured to measure a pressure between the ball 540 and the target printing object 460 and send the measurement result to the control part 510. Although a pressure exerted to the elastic portion 525 by the supporting bar 530 is measured by the pressure measuring part 550, it may be substantially equivalent to a pressure exerted between the target printing object 460 and the ball 540.

In the micro ballpoint pen 500 of FIG. 6, the pressure measured by the pressure measuring part 550 may be sent to the control part 510. This enables to improve uniformity in a pressure between the target printing object 460 and the ball 540, thereby uniformly maintaining the ink outflowing channel during a printing process. Furthermore, due to the presence of the pressure measuring part 550, a change in pressure between the target printing object 460 and the ball 540 can be feedbacked to the control part 510 controlling the tip body 520. This enables to perform an exact printing of a complex pattern (e.g., dashed, broken and wavy lines).

Figure 7:
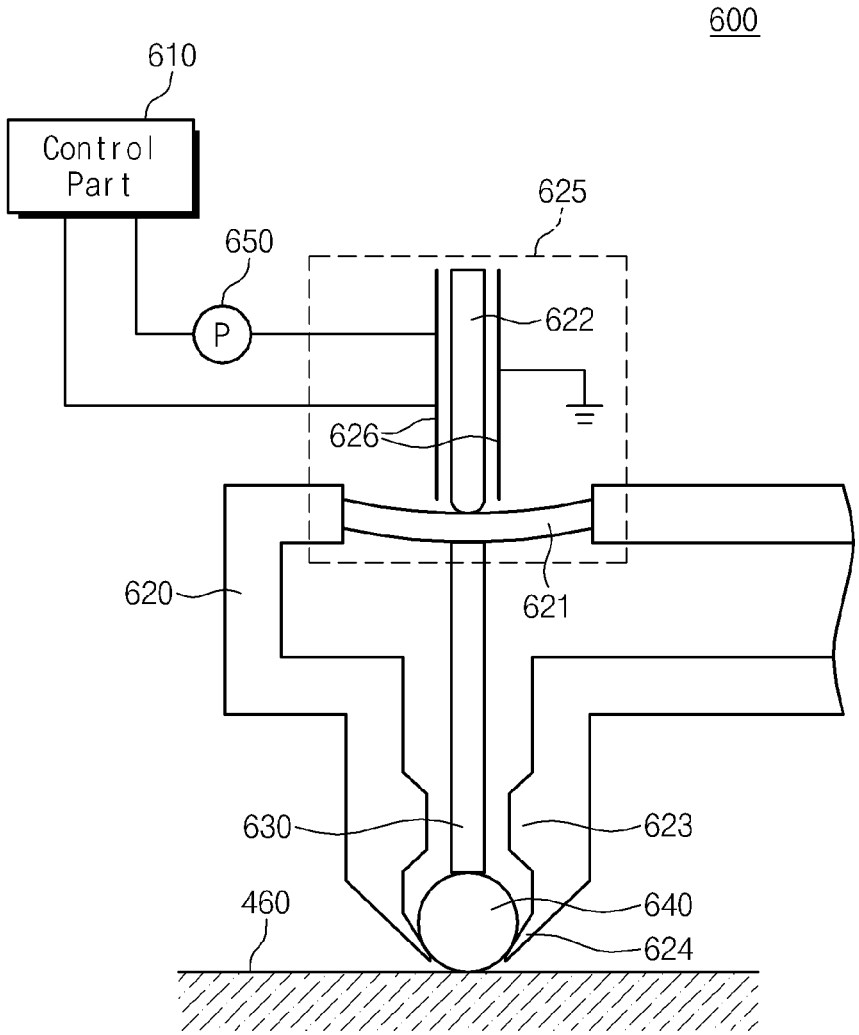
FIG. 7 is a diagram illustrating a micro ballpoint pen according to further example embodiments of the inventive concept.

FIG. 7 is a diagram illustrating a micro ballpoint pen according to further example embodiments of the inventive concept. Referring to FIG. 7, a micro ballpoint pen 600 may include a control part 610, a tip body 620, a supporting bar 630, a ball 640 and a pressure measuring part 650.

In the embodiments depicted in FIG. 7, the control part 610, the tip body 620, an elastic portion 625, an electrode 626, a deformable piezoelectric material 622, a membrane 621, an inner protrusion 623, a caulking portion 624, the supporting bar 630, and the ball 640 may be configured to have the same technical features as those in the previous embodiments described with reference to FIG. 3, and thus, detailed discussion thereof will be omitted in order to avoid redundancy.

Referring to FIG. 7, the pressure measuring part 650 may be configured to measure a pressure between the ball 640 and the target printing object 460 and send the measurement result to the control part 610. Although a pressure exerted to the elastic portion 625 by the supporting bar 630 is measured by the pressure measuring part 650, it may be substantially equivalent to a pressure exerted between the target printing object 460 and the ball 640.

In the micro ballpoint pen 600 of FIG. 7, the pressure measured by the pressure measuring part 650 may be sent to the control part 610. This enables to improve uniformity in a pressure between the target printing object 460 and the ball 640, thereby uniformly maintaining the ink outflowing channel during a printing process. Furthermore, due to the presence of the pressure measuring part 650, a change in pressure between the target printing object 460 and the ball 640 can be feedbacked to the control part 610 controlling the tip body 620. This enables to perform an exact printing of a complex pattern (e.g., broken and wavy lines).

Figure 8:
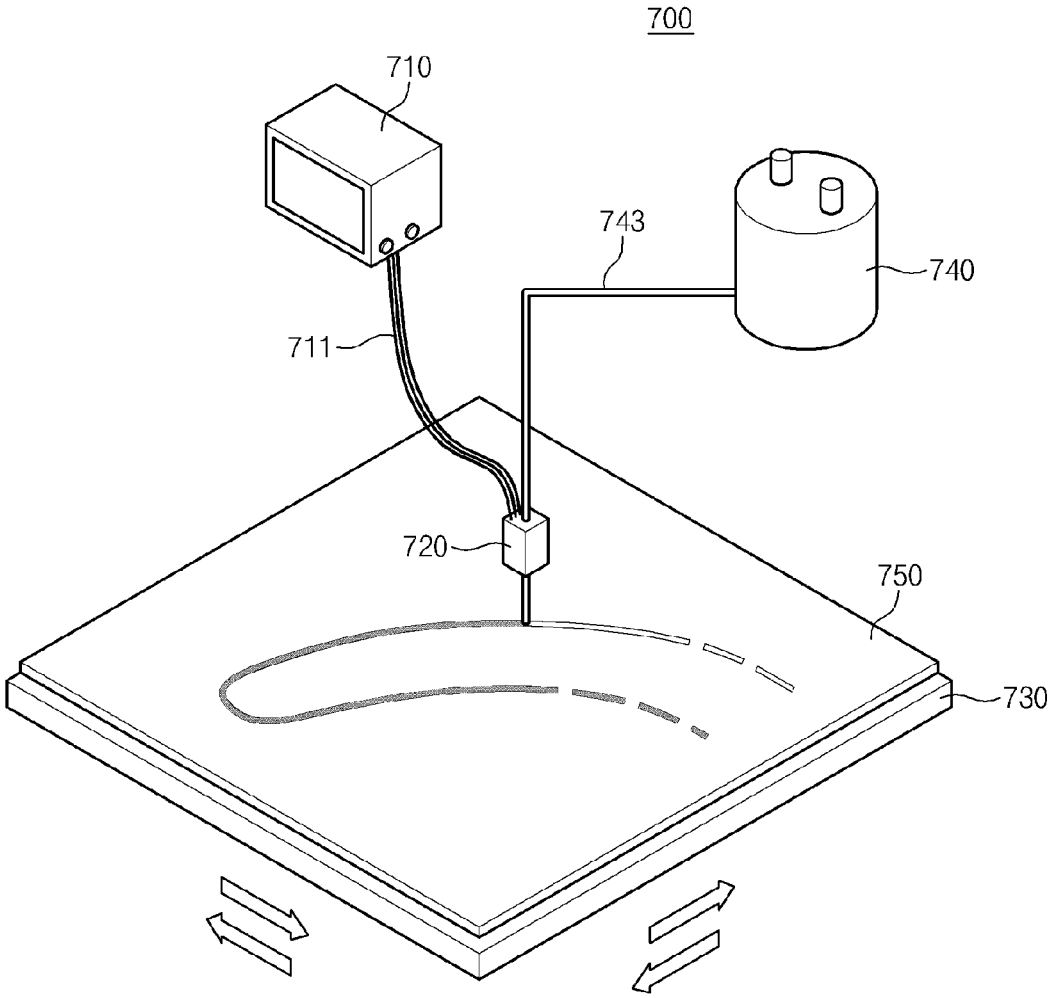
FIG. 8 is a diagram illustrating a printing apparatus according to example embodiments of the inventive concept.

FIG. 8 is a diagram illustrating a printing apparatus according to example embodiments of the inventive concept. Referring to FIG. 8, a printing apparatus 700 may include a control part 710, a micro ballpoint pen 720, and a stage 730.

A target printing object 750 may be loaded on the stage 730. The stage 730 may be configured to be movable along X, Y, and/or Z-axes in response to a control signal from the control part 710.

The micro ballpoint pen 720 may be one of the micro ballpoint pen 100 to 600 described with reference to FIG. 1 and FIGS. 3 through 7. For example, the micro ballpoint pen 720 may be configured to have the same technical features as those in the previous embodiments described with reference to FIGS. 1, and 3 through 7, and thus, detailed discussion thereof will be omitted in order to avoid redundancy. In the present embodiments, the micro ballpoint pen 720 of FIG. 8 may be configured not to include an internal control part (for example, 110 in FIG. 1), unlike those described with reference to FIGS. 1, and 3 through 7. Instead of providing the internal control part, the printing apparatus 700 may include a control part 710 additionally provided at the outside of the micro ballpoint pen 720, as will be described below.

The control part 710 may control X-, Y-, and/or Z-directional movements of the stage 730 and a movement of the micro ballpoint pen 720. The control part 710 may be connected to the stage 730 and the micro ballpoint pen 720 using a wired or wireless communication system, and thus, a control signal from the control part 710 can be delivered to the stage 730 and the micro ballpoint pen 720. As show exemplarily in FIG. 8, the control part 710 may be connected to the micro ballpoint pen 720 through a wire 711, while it may be wirelessly connected to the stage 730.

Referring to FIG. 8, the printing apparatus 700 may further include an ink supplying part 740, which may be configured to supply ink to the micro ballpoint pen 720 in response to the control signal of the control part 710. The ink, as needed, may be supplied from the ink supplying part 740 to the micro ballpoint pen 720 via a conduit 743.

Figure 9A:
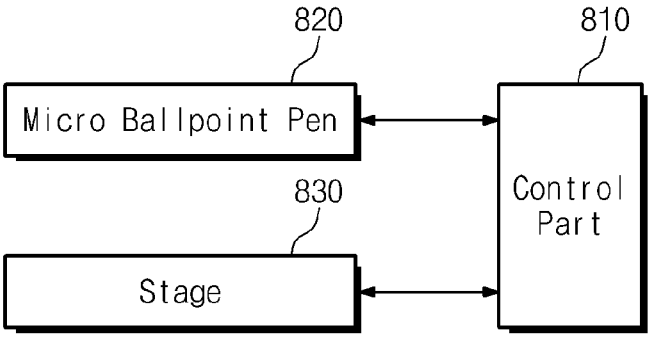
FIG. 9A is a block diagram illustrating a printing apparatus according to example embodiments of the inventive concept.

FIG. 9A is a block diagram illustrating a printing apparatus according to example embodiments of the inventive concept. Referring to FIG. 9A, a printing apparatus may include a control part 810, a micro ballpoint pen 820, and a stage 830.

The control part 810, the micro ballpoint pen 820 and the stage 830 may be configured to have the same technical features as those in the previous embodiments described with reference to FIG. 8, and thus, detailed discussion thereof will be omitted in order to avoid redundancy.

Referring to FIG. 9A, the control part 810 may be configured to generate a control signal for controlling operations and/or movements of the micro ballpoint pen 820 and the stage 830 as well as to receive, from the micro ballpoint pen 820 and the stage 830, data for exactly controlling the micro ballpoint pen 820 and the stage 830. In other words, the control part 810 may be configured to communicate bi-directionally with the micro ballpoint pen 820 and/or the stage 830.

Figure 9B:
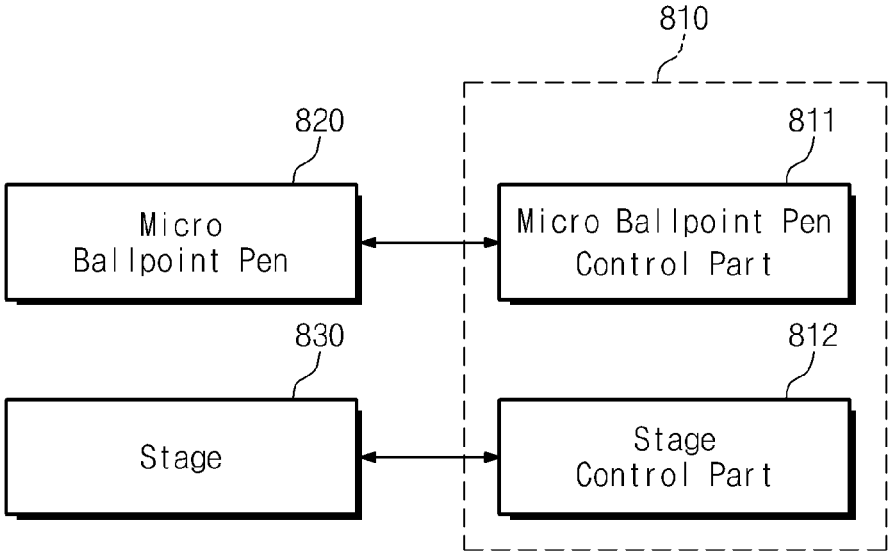
FIG. 9B is a block diagram illustrating printing apparatus according to other example embodiments of the inventive concept.

FIG. 9B is a block diagram illustrating printing apparatus according to other example embodiments of the inventive concept. Referring to FIG. 9B, a printing apparatus may include the control part 810, the micro ballpoint pen 820, and the stage 830.

The printing apparatus of FIG. 9B may include the control part 810 provided with a micro ballpoint pen control part 811 and a stage control part 812, unlike that of FIG. 9A. The micro ballpoint pen control part 811 may control an operation of the micro ballpoint pen 820, and the stage control part 812 may control an operation of the stage 830.

Figure 10A:
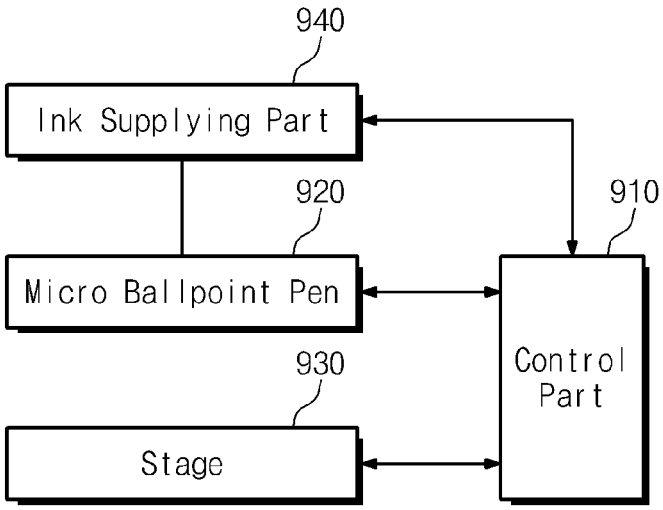
FIG. 10A is a block diagram illustrating printing apparatus according to still other example embodiments of the inventive concept.

FIG. 10A is a block diagram illustrating printing apparatus according to still other example embodiments of the inventive concept. Referring to FIG. 10A, a printing apparatus may include a control part 910, a micro ballpoint pen 920, a stage 930, and an ink supplying part 940.

The control part 910, the micro ballpoint pen 920, the stage 930, and the ink supplying part 940 may be configured to have the same technical features as those in the previous embodiments described with reference to FIG. 8, and thus, detailed discussion thereof will be omitted in order to avoid redundancy.

Referring to FIG. 10A, the control part 910 may be configured to generate a control signal for controlling operations and/or movements of the micro ballpoint pen 920, the stage 930, and the ink supplying part 940 as well as to receive, from the micro ballpoint pen 920, the stage 930, and the ink supplying part 940, data for exactly controlling the micro ballpoint pen 920, the stage 930, and the ink supplying part 940. In other words, the control part 910 may be configured to communicate bi-directionally with the micro ballpoint pen 920, the stage 930, and/or the ink supplying part 940.

Figure 10B:
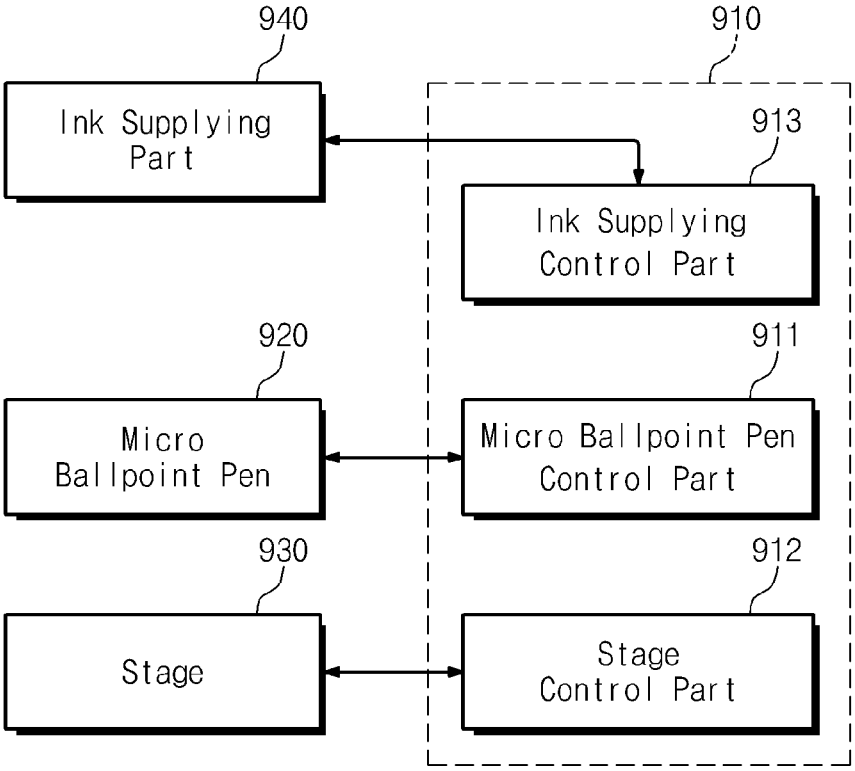
FIG. 10B is a block diagram illustrating printing apparatus according to even other example embodiments of the inventive concept.

FIG. 10B is a block diagram illustrating printing apparatus according to even other example embodiments of the inventive concept. Referring to FIG. 10A, a printing apparatus may include the control part 910, the micro ballpoint pen 920, the stage 930, and the ink supplying part 940.

The printing apparatus of FIG. 10B may include control part 910 provided with a micro ballpoint pen control part 911, a stage control part 912, and an ink supplying control part 913, unlike that of FIG. 10A. The micro ballpoint pen control part 911 may control an operation of the micro ballpoint pen 920, the stage control part 912 may control an operation of the stage 930, and the ink supplying control part 913 may control an operation of the ink supplying part 940.

The printing apparatus described with reference to FIGS. 8 through 10 may control the position and/or movement of a ball using the elastic electrode and the piezoelectric actuator or using the deformable piezoelectric material and the membrane. The ink outflowing channel may be formed in a gap-on-demand (GOD) manner, and the ink may be directly ejected onto the target printing object using a rotating movement of the ball rolling on the surface of the target printing object. As a result, the printing apparatus according to example embodiments of the inventive concept can provide various technical advantages in a printing process, such as a fine control of the ink outflowing channel and a simple operational mechanism (e.g., the rotating or rolling of the ball). In addition, since a mechanical deformation of the piezoelectric actuator and/or the membrane is used to eject the ink, there is no limitation on ink to be used.

The printing apparatus described with reference to FIGS. 8 through 10 may further include a pressure measuring part, which may be configured to measure a pressure between the ball and a target printing object and send the measurement result to the control part. Due to the presence of the pressure measuring part, it is possible to improve uniformity in a pressure between the target printing object and the ball, thereby uniformly maintaining the ink outflowing channel during a printing process. In addition, a change in pressure between the target printing object and the ball can be feedbacked to the control part controlling the tip body. This enables to perform an exact printing of a complex pattern (e.g., broken and wavy lines).

According to example embodiments of the inventive concept, a micro ballpoint pen and a printing apparatus may allow to print directly straight, oblique, curved, dashed, broken and wavy lines, which may be hard to be printed by a conventional printing method. In addition, according to a ball size and a ball gap, it is possible to print a line in the order of micrometer. This enables to print exactly a complex line or pattern (e.g., having a complex edge) without a shadow mask or an engraving. In addition, this enables to reduce ink consumption.

While example embodiments of the inventive concepts have been particularly shown and described, it will be understood by one of ordinary skill in the art that variations in form and detail may be made therein without departing from the spirit and scope of the attached claims.

What is claimed is:

1. A micro ballpoint pen, comprising:

a tip body including a caulking portion, at least one inner protrusion, and at least one expansible or shrinkable elastic portion;

a ball provided between the caulking portion and the inner protrusion, the ball contacting and rolling on a target printing object to eject ink onto the target printing object;

a supporting bar pressing the ball toward the caulking portion to form an ink outflowing channel between the caulking portion and the ball; and a control part expanding or shrinking the elastic portion to control the ink outflowing channel.

2. The micro ballpoint pen of claim 1, wherein the elastic portion comprises an elastic electrode and a piezoelectric actuator, and the piezoelectric actuator is surrounded by the elastic electrode and is bent toward an inner space of the tip body in response to a control signal transmitted from the control part through the elastic electrode.

3. The micro ballpoint pen of claim 2, wherein the at least one elastic portion is provided in a side wall of the tip body and the number of the at least one elastic portion is one or more, a lower portion of the supporting bar is in contact with the ball, a side surface of an upper portion of the supporting bar is in contact with an inner side surface of the elastic portion, the piezoelectric actuator is bent to press the supporting bar toward the caulking portion, and the ink outflowing channel is controlled by changing a position of the supporting bar.

4. The micro ballpoint pen of claim 3, further comprising, a pressure measuring part measuring a pressure between the ball and the target printing object and sending the measurement result to the control part.

5. The micro ballpoint pen of claim 3, wherein the upper portion of the supporting bar defines a hole allowing the ink to be delivered to a surface of the ball.

6. The micro ballpoint pen of claim 2, wherein the elastic portion is in contact with a top surface of an upper portion of the supporting bar, a lower portion of the supporting bar is in contact with the ball, the upper portion of the supporting bar is in contact with an inner surface of the elastic portion, the piezoelectric actuator is bent to press the supporting bar toward the caulking portion, and the ink outflowing channel is controlled by changing a position of the supporting bar.

7. The micro ballpoint pen of claim 6, further comprising a pressure measuring part measuring a pressure between the ball and the target printing object and sending the measurement result to the control part.

8. The micro ballpoint pen of claim 1, wherein the elastic portion comprises a deformable piezoelectric material, an electrode, and a membrane, the piezoelectric material is upward or downward moved to press the membrane, in response to a control signal transmitted from the control part through the electrode.

9. The micro ballpoint pen of claim 8, wherein the elastic portion is in contact with a top surface of an upper portion of the supporting bar, a lower portion of the supporting bar is in contact with the ball, an upper portion of the supporting bar is in contact with the membrane, the membrane is bent toward an inner space of the tip body by the pressing of the piezoelectric material, thereby pressing the supporting bar toward the caulking portion, and the ink outflowing channel is controlled by changing a position of the supporting bar.

10. The micro ballpoint pen of claim 9, further comprising a pressure measuring part measuring a pressure between the ball and the target printing object and sending the measurement result to the control part.

11. A printing apparatus, comprising:

a stage loading a target printing object and being movable along X-, Y- and/or Z-axis;

a micro ballpoint pen ejecting ink onto the target printing object; and a control part controlling operations of the stage and the micro ballpoint pen, wherein the micro ballpoint pen comprises:

a tip body including a caulking portion, at least one inner protrusion, and at least one elastic portion, whose expansion or shrinkage is controlled by the control part;

a ball provided between the caulking portion and the inner protrusion, the ball contacting and rolling on the target printing object to eject ink onto the target printing object; and a supporting bar pressing the ball toward the caulking portion to form an ink outflowing channel between the caulking portion and the ball.

12. The printing apparatus of claim 11, wherein the control part comprises a pressure measuring part configured to measure a pressure between the ball and the target printing object and send the measurement result to the control part.

13. The printing apparatus of claim 11, wherein the elastic portion comprises an elastic electrode and a piezoelectric actuator, the piezoelectric actuator is surrounded by the elastic electrode and is bent toward an inner space of the tip body in response to a control signal from the control part, the piezoelectric actuator is bent to press the supporting bar toward the caulking portion, and the ink outflowing channel is controlled by changing a position of the supporting bar.

14. The printing apparatus of claim 11, wherein the elastic portion comprises a deformable piezoelectric material, an electrode, and a membrane, the piezoelectric material is upward or downward moved to press the membrane, in response to a control signal from the control part, the membrane is bent toward an inner space of the tip body by the pressing of the piezoelectric material, thereby pressing the supporting bar toward the caulking portion, and the ink outflowing channel is controlled by changing a position of the supporting bar.

15. The printing apparatus of claim 11, wherein the control part comprises:

a micro ballpoint pen control part controlling extension or shrinkage of the elastic portion to control an operation of the micro ballpoint pen; and a stage control part controlling an operation of the stage.

16. The printing apparatus of claim 11, further comprising an ink supplying part configured to supply the ink into the micro ballpoint pen in response to the control signal of the control part.

17. The printing apparatus of claim 16, wherein the control part comprises:

a micro ballpoint pen control part controlling extension or shrinkage of the elastic portion to control an operation of the micro ballpoint pen;

a stage control part controlling an operation of the stage; and an ink supplying control part controlling the ink supplying part.

* * * * *